US006408732B1

(12) United States Patent
Rexroad et al.

(10) Patent No.: US 6,408,732 B1
(45) **Date of Patent: *Jun. 25, 2002**

(54) CLIMBING NET

(76) Inventors: John Rexroad, 146 Grassy Hill Rd., Old Lyme, CT (US) 06371; Merle Kingham, 8966 E. Voltaire Dr., Scottsdale, AZ (US) 85254

( * ) Notice: Subject to any disclaimer, the term of this patent is extended or adjusted under 35 U.S.C. 154(b) by 0 days.

This patent is subject to a terminal disclaimer.

(21) Appl. No.: 08/153,623

(22) Filed: Nov. 17, 1993

(51) Int. Cl.[7] ..... D04G 1/00
(52) U.S. Cl. ..... 87/12
(58) Field of Search ..... 87/5, 12, 13, 53, 87/62

(56) References Cited

U.S. PATENT DOCUMENTS

| | | | | | |
|---|---|---|---|---|---|
| 1,700,192 | A | * | 1/1929 | Appleyard | 87/12 |
| 2,194,865 | A | | 3/1940 | Mizugoshi | |
| 2,407,031 | A | | 9/1946 | Morcaldi D' | |
| 2,600,395 | A | * | 6/1952 | Domoj et al. | 87/13 |
| 2,659,956 | A | | 11/1953 | Lilienfeld | |
| 2,792,617 | A | | 5/1957 | Haller | |
| 2,817,263 | A | | 12/1957 | Pedley et al. | |
| 2,823,576 | A | | 2/1958 | Needham et al. | |
| 3,039,348 | A | | 6/1962 | Grabowsky et al. | |
| 3,047,860 | A | | 7/1962 | Swallow et al. | |
| 3,170,611 | A | | 2/1965 | Gullen | |
| 4,000,344 | A | * | 12/1976 | Dilbey | 87/12 |
| 4,158,985 | A | | 6/1979 | Looker et al. | |
| 4,619,108 | A | | 10/1986 | Hotta | |
| 4,651,620 | A | | 3/1987 | Lyons | |
| 4,892,210 | A | | 1/1990 | Kupersmit | |
| 4,895,366 | A | | 1/1990 | Bartasius | |
| 4,948,129 | A | | 8/1990 | Bartasius | |
| 5,328,310 | A | * | 7/1994 | Lockney | 87/12 X |

* cited by examiner

*Primary Examiner*—Daniel P. Stodola

(57) ABSTRACT

A net and related method employs weft and warp members arranged in an alternating diagonally disposed pattern such that portions of each weft and warp member are made to turn ninety degrees through nodes such that each member at one point makes up at least one rung and one rail of the net. The net further is made from non-abrasive multifilaments consisting essentially of polypropylene or propylene ethylene copolymer.

11 Claims, 2 Drawing Sheets

CLIMBING NET

BACKGROUND OF THE INVENTION

This invention relates to improvements in and to climbing nets and relates more particularly to improvements with regard to the texture of cordage used in such nets and improvements to climbing net construction thereby avoiding problems heretofor known with conventional climbing net designs.

Climbing nets have been used for recreational and utilitarian purposes for many years. In such conventional construction, rope or cordage is used and is connected at nodes to create a lattice of vertically extending rails and horizontally extending rungs which create the netting. In such conventional net constructions, the lattice is defined by nodes of connected vertical and horizontal lengths of cord which become laterally unstable when a downward force is applied to individual rungs, as opposed to causing the line of action to be contained substantially in a vertical line.

Also, in previous types of cordage used in nets, polymers made up of monofilaments have been widely used. These monofilaments which when exposed to UV light, often become brittle and sever causing barb-like projections to extend transversely from the rope. Needless to say, such projections present a hazard, for example, to children in the case where the net is used for recreational purposes. Even if the rope material is not polymer based, i.e., formed from hemp or any other naturally occurring material, these natural strands tend to themselves be abrasive and thus are not desirable stock materials for use in an environment where gripping and sliding of exposed surfaces of skin will occur.

Also, it has been found in applications, such as in playgrounds and other such recreational environments, that hanging cargo nets from a suspended frame provides an attractive exercise device for children of all ages. Further, it is desirable to color the net and each cord thereof to a specific color scheme of the playground in order to coordinate the net coloring with the overall color theme of the playground structure. As such, the need to provide a colorfast netting, i.e. one in which color does not fade or abrade away from the material, is thus apparent.

An object of the invention is thus to provide a net lattice of the type wherein the lattice is constructed of lengths of cord which create a laterally and vertically stable net lattice structure.

It is a further object of the invention to provide a climbing net formed from a material which is non-abrasive and is suitable for touching and climbing by, for example, children.

SUMMARY OF THE INVENTION

The invention resides in one of its aspects in a net and a related method of making same of the type having horizontally disposed rungs and vertically disposed rails comprises a border enclosing an area defined by first, second, third and fourth corners to create an enclosure in which the rungs and rails are contained. A first border section is provided and extends between said first and second corners, a second border section is provided and extends lengthwise between the second and third corners, a third border section is provided and extends between the third and fourth corners and a fourth border section is provided and extends lengthwise between the fourth and first corners.

A plurality of weft members are provided and are connected in a row in spaced relationship to one another along one of the first, second, third and fourth length portions of the border. A plurality of warp members are provided and are connected in a row in spaced relationship to one another along another of the first, second, third and fourth length portions of the border which is orthogonally disposed relative to said one of said first, second, third and fourth length portions of said border. The weft and the warp members together create horizontally extending rungs and vertically extending rails by the interconnection of weft and weft members, warp and warp members and weft and warp members such that each weft and each warp member makes up at least one rung and one rail of the net.

The invention further resides in a nonabrasive netting material for climbing nets comprised of elongate multifilaments consisting essentially of polypropylene or propylene ethylene copolymer.

BRIEF DESCRIPTION OF THE DRAWINGS

A file of this patent contains at least one drawings executed in color. Copies of this patent with color drawings will be provided by the Patent and Trademark Office upon request and payment of the necessary fee.

DETAILED DESCRIPTION OF THE PREFERRED EMBODIMENT

Figure 1:
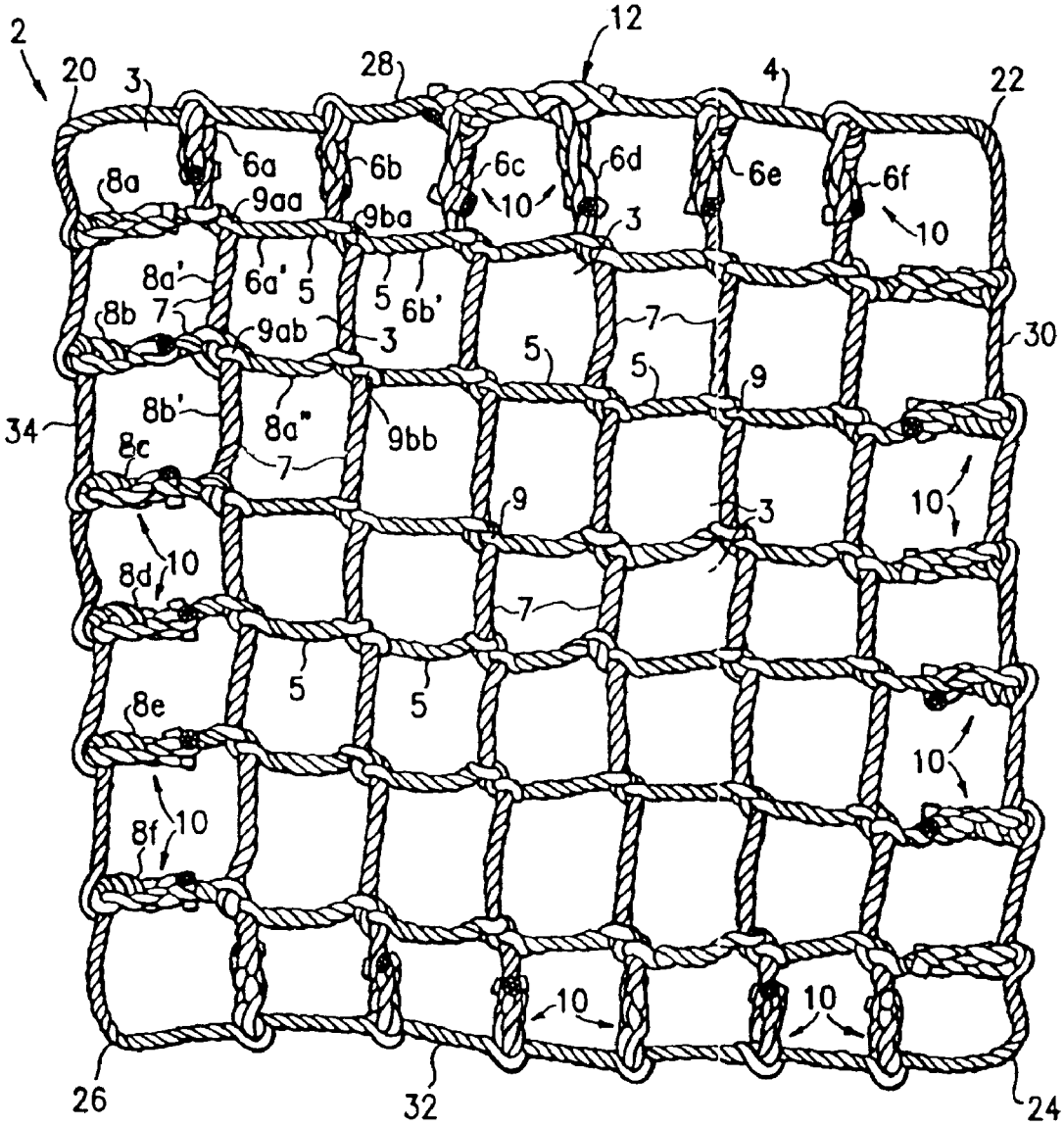
FIG. 1 is a plan view of the net lattice embodying the invention.

FIG. 1 illustrates a net 2 having a lattice design comprised of vertically and horizontally disposed rows of rope boxes 3,3 arranged in a matrix embodying the invention. The net lattice is comprised of a plurality of rope cords which create horizontally extending rungs 5,5 which can be used for example, as footholds and handholds in a climbing net arrangement, and held in vertically spaced relationship by vertically extending rails 7,7, which likewise make up portions of the lengths of the rope cords. As used hereinafter, the term "member" is to mean a length of rope cord which make up a part of the rails or rungs of the lattice.

In the illustrated example of FIG. 1, the net 2 is comprised of a border cord 4 which encloses an area defined by the lattice of vertically and horizontally disposed rope boxes 3,3, each approximately 5"–7" square, which are connected to the border in a manner which will hereinafter become apparent. The border member 4 is further defined by four corner points 20, 22, 24, and 26 which taken successively in pairs, define a first border section 28 extending lengthwise between the first and second corner points 20 and 22, a second border section 30 extending lengthwise between the second and third corner points 22 and 24, a third border section 32 extending between the third and fourth corner points 24 and 26, and a fourth border section 34 extending lengthwise between the fourth and the first corner points 26 and 20. The border member 4 is itself a single piece of cord which is spliced at its free ends in a conventional way at a main splice 12. In this way, the enclosed area of the net is defined and is so structured as to provide end connections for the rungs 5,5 and rails 7,7 which make up the net.

Figure 3:
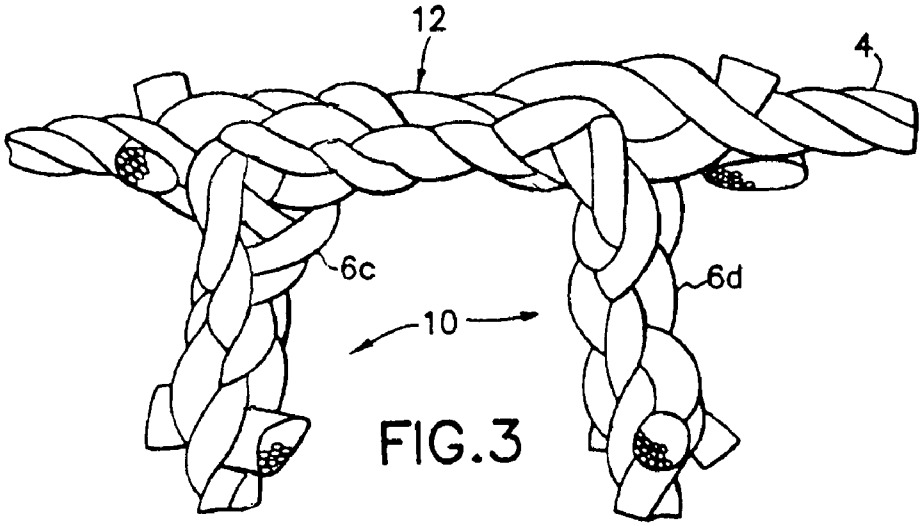
FIG. 3 is a partially fragmentary view showing the end connection for the border member with two end weft splices connected thereto
Figure 2:
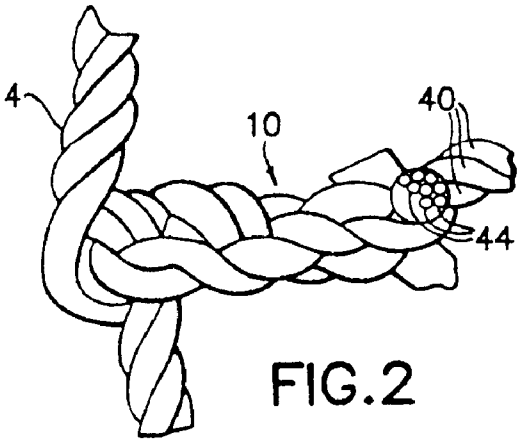
FIG. 2 is a partially fragmentary view taken of an end splice connection between the border rope and a warp member.
Figure 4:
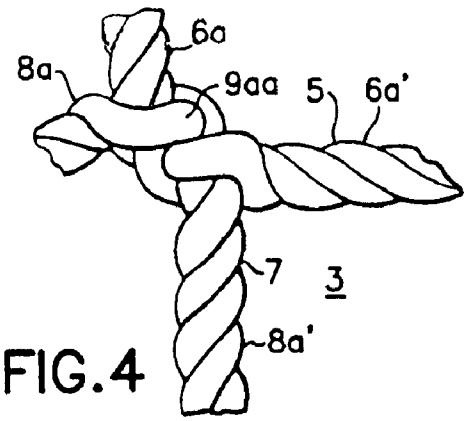
FIG. 4 shows a node between weft and warp members in a twisted cordage system.

The rope boxes while at fist glance appear to be defined by vertically and horizontally extending lengths of cord, are in fact defined by a plurality of weft members 6*a*, 6*b*, 6*c*, 6*d*, 6*e* and 6*f* and warp members 8*a*, 8*b*, 8*c*, 8*d*, and 8*e* which interconnect with each other so as to be arranged in a stepwise diagonally disposed arrangement across the enclosure defined by the border member 4 of the net 2. To this end, and for ease of discussion, it should be seen that each of the weft members 6*a*, 6*b*, 6*c*, 6*d*, 6*e*, and 6*f* is connected in a row in spatial relationship to one another at one end thereof to the first border section 28 of the border cord 4, and at least with regard to the portion of each weft member immediately connecting to the first border portion, are disposed initially, in a vertical disposition. The rope boxes 3,3 are further defined by a plurality of warp members 8*a*, 8*b*, 8*c*, 8*d*, 8*e*, and 8*f* which are each connected at one end thereof in a row spatial relationship to the fourth border section 34, and at least with regard to the portion of each warp member immediately connecting to the fourth border section 34, are disposed initially, in a horizontal disposition. Each of the weft and warp members connect to the border cord 4 along an associated length thereof through appropriate conventional splices 10,10 as illustrated for example, in FIG. 2. As mentioned, the border cord 4 is spliced to itself at its ends at a main splice 12, but which main splice, as better seen in FIG. 3, includes two weft member splices connected at the points where weft members 6*c* and 6*d* attach to the associated length of the first border portion 28. The splices 10,10 and 12 are simple splices which are known in the art and can be readily referenced in many publications, such as, for example, in *Knights Modern Seamanship*, Sixth Edition, published by Litton Educational Publishing Inc.

In the illustrated example of FIGS. 1–4, the weft, warp and border members are each comprised of twisted lengths of cord which can be made up of a plurality of strands. As illustrated, these members are made up of three twisted strands illustrated as 40,40, 40, which define each cord diameter of about one inch. Each strand, in accordance with the invention, is further made up of a plurality of elongate extruded microfine multifilaments 44,44 made from polypropylene or a propylene ethylene copolymer and are sold commercially by PHILLIPS PETROLEUM COMPANY of Bartlesville, Okla., 74004, under the tradename MARLEX , under CAS numbers 9003-07-0 and 9010-79-1. The strands 40,40,40 in the illustrated embodiment, are each formed from reverse twisted lengths of multifilaments which prevent unravelling. The fabrication of cordage made from these microfine elongate multifilaments in climbing nets, offers an improvement in climbing net construction regardless of the choice of lattice structure used, in that the multifilaments, given their highly fine characteristics, offer a softer touch to the user, even when such multifilaments sever, than previously used strands. Also, the multifilaments made by this manufacturer may be purchased as colored stock material as part of the manufacturing process, which process renders the material color-fast.

The system of interconnecting weft members 6*a* . . . 6*f* and warp members 8*a* . . . 8*f* connect with one another at nodes 9,9 in such a way as to cause selected length portions of the weft and warp members to be turned orthogonally in directions other than that which each member had followed prior to entering the involved node in order to create the horizontally extending rungs 5,5 and the vertically extending rails 7,7 as the weft and warp members follow a diagonal path across the border member 4. To these ends, the construction of the net 2 is best described taking the progression of nodes relative to the first corner 20 and working diagonally across the border enclosure to the opposite corner 24. As such, the first weft member 6*a* intersects with the first warp member 8*a* at node 9*aa* such that the first weft member 6*a* pierces the first warp member 8*a* between one and the remaining two strands 40,40 of the warp member 8*a* and thereafter turns ninety degrees to the right so as to be disposed horizontally and define a new weft length 6*a*' which creates a rung 5 in the lattice. In turn, the first warp member 8*a* then pierces the first weft member 6*a* at a point immediately adjacent the node 9*aa* between one and the remaining two strands 40,40 of the first weft member length 6*a*, and thereafter turns ninety degrees downwards to define a new warp length 8*a*, which creates a rail in the system. Thereafter, the second weft member 6*b* pierces the new first weft length 6*a*' in the same manner as discussed above at a point therealong in line with the connection between the weft 6*b* and the border rope 4 and turns ninety degrees to the right to define a horizontally disposed new second weft length 6*b*' that creates another one of the rungs 5,5. The new first weft length 6*a*' then pierces the second weft member 6*b* in the same manner as discussed above, and is then turned ninety degrees downwards to define another new first weft member length 6*a*" which creates one of the rails 7,7 which is again turned to the right ninety degrees at node 9*bb*. Similarly, the new length of the first warp length 8*a*' pierces the second warp member 8*b* in the same manner discussed above at node 9*ba* and thereafter is caused to turn right to define another new length 8*a*" which is disposed horizontally to define a rung 5 of the net. Also, the second warp member is caused to turn downwards ninety degrees to define a new warp length 8*b*' which then defines a rail member 7 in the system. This process of creating alternating rung and rail members continues until all weft and warp members connect to associated ones of the second and third border portion lengths 30 and 32 respectively. The net construction shown in FIGS. 1–4, creates a highly stable lattice in a vertical sense in that loads applied to the net through the rungs 5,5 act directly through the vertically disposed rails 7,7 made up the alternating weft and warp members. Additionally, as can be appreciated from the drawing of FIG. 1, the diagonally disposed alternating vertical paths followed by the weft and warp members create a particularly aesthetically pleasing color scheme when colored cordage is used. As previously mentioned, the material from which the cordage is made, is color-fast, meaning that it is not susceptible to fading or rubbing off on the hands of the users, e.g. children, thereby ideally lending itself to use, for example, in playgrounds.

Figure 5:
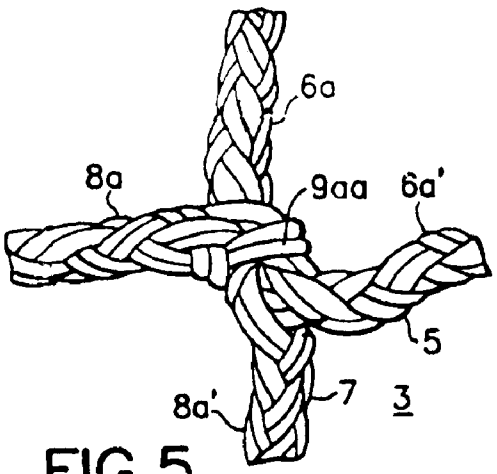
FIG. 5 illustrates a locus between weft and warp members in a braid cordage system.

Referring now to FIG. 5, it should be seen that the cordage from which the net 2 can be made can alternatively be of a braid type. In this embodiment, the braid is an eight strand conventional braid, with the primary difference between this embodiment and that shown in FIGS. 1–4 is that piercing at nodes between interconnecting weft and weft members, warp and warp members and/or weft and warp members is that the piercing member splits the pierced member equally between four and four of the strands which make up its diameter. The strands making up the braid version of the net 2, are again multifilaments manufactured by PHILLIPS PETROLEUM COMPANY and sold under the tradename MARLEX as discussed above.

By the foregoing, an improved net design has been disclosed by way of the preferred embodiment. However, it should be understood that numerous substitutions and modifications may be had without departing from the spirit of the invention. For example, the invention contemplates using cordage made from the MARLEX not strictly in the disclosed lattice structure of the net disclosed, but rather contemplates its use in a conventional climbing net construction as well, given the advantages which may be achieved by preventing burns and cuts which otherwise occur when conventional materials are used. Likewise, in the embodiments disclosed above, cordage made from twisted or braided lengths are disclosed. However, it is well within the purview of the invention to use any braidable cordage comprised of any number of strands, such as, a hollow braid, to accomplish the construction of the net illustrated in FIG. 1. Also, the border member 4 may not necessarily need to be entirely closed, but rather may have one length taken up, for example, by a horizontal bar to which the weft members and the second and fourth border lengths attach.

Accordingly, the invention has been described by way of illustration rather than limitation.

We claim:

1. A net of the type having horizontally disposed rungs and vertically disposed rails comprising:

a border comprised of an elongated member having first and second ends spliced together to create an enclosing area defined by first, second, third and fourth corners;

a first border portion extending between said first and second corners, a second border portion extending lengthwise between said second and third corners, a third border portion extending between said third and fourth corners and a fourth border portion extending lengthwise between said fourth and first corners;

a plurality of weft members arranged in a row in spaced relationship to one another along one of said first, second, third and fourth border portions, said plurality of weft members being connected to on e of said first, second, third and fourth border portions by splicing each of said weft members at one end thereof into the associated border portion to which it is connected, at least one of said plurality of weft members being differently colored from the remaining ones of saled plurality of weft members;

two side by side ones of said plurality of weft members which are arranged in a row in spaced relationship to one another along one of said first, second, third and fourth border portions being of a different color taken relative to the color of at least one other weft arranged in said row in spaced relationship to one another along said one of said first, second, third and fourth border portions;

a plurality of warp members connected in a row in spaced relationship to one another along another of said first, second, third and fourth border portions which is orthogonally disposed relative to said one of said first, second, third and fourth border portions of said border to which said plurality of weft members are connected, said plurality of warp members being connected to the one of said first, second, third and fourth border portions by splicing each of said warp members at one end thereof into the associated border portion to which it is connected, two side by side ones of said plurality of warp members which are arranged in said row in spaced relationship to one another along one of said first, second, third and fourth border portions being differently colored from the color of at least one other of the remaining ones of said plurality of warp members in said row;

said weft and said warp members together creating horizontally extending rungs and vertically extending rails by the interconnection of weft and weft members, warp and warp members and weft and warp members such that each weft and each warp member makes up at least one rung and one rail of the net; and said at least one of said weft and warp members of a different color taken relative to the color of said at least one other weft and warp member displaying a diagonally directed path along the net relative to the differently colored ones of the warp and weft members.

2. A net as defined in claim 1 further characterized in that said weft members being connected at one end thereof along said first border portion and said warp members being connected at one end thereof along said fourth border portion and taking the most proximate weft and warp members relative to said first corner, the first of such weft members pierces the first of the warp members and the first of said weft members is turned laterally ninety degrees after piercing the first warp member towards said second border portion and said second weft member pierces the laterally extending portion of the first weft member so that a length of said first warp member is downwardly turned and pierces a second warp member and is thereafter turned laterally 90 degrees toward said second border portion in progression until a plurality of rails and rungs are created between the border portions of the net.

3. A net as defined in claim 2 further characterized by said weft and warp members being formed from a color-fast material each having a different color to create a diagonally extending color pattern in said net.

4. A net as defined in claim 3 further characterized in that said of weft and said warp members are braid members comprised of equal number of strands with the interconnection between weft and weft, weft and warp and warp and warp members being effected by the piercing of one member into the other by an equal split of the strands which create the braid.

5. A net as defined in claim 3 further characterized each of said weft and warp members being connected at said border through a splice and wherein the border of said net is a continuous member which is connected together along one of said first, second, third and fourth border portions of said border.

6. A net as defined in claim 1 further characterized in that each of said weft and warp members is made from elongate extruded multifilaments consisting essentially of polypropylene or propylene ethylene copolymer.

7. A net as defined in claim 1 further characterized in that each of said weft and warp members is a twisted member made from elongate extruded multifilaments consisting essentially of polypropylene or propylene ethylene copolymer having at least three strands comprised of reverse twisted microfine elongate multifilaments which in turn are twisted to create each of the weft and warp members.

8. A method of making a climbing net having vertically disposed rails and horizontally disposed rungs, said method comprising the steps of:

providing an area defined by first, second, third and fourth corners to create an enclosure;

providing a first border portion extending between said first and second corners, a second border portion extending lengthwise between said second and third corners, a third border portion extending between said third and fourth corners and a fourth border portion extending lengthwise between said fourth and first corners;

providing a plurality of weft members connected in a row in spaced relationship to one another along one of said first, second, third and fourth border portions, connecting said plurality of weft members to one of said first, second, third and fourth border portions by splicing each of said weft members at one end thereof into the associated border portion to which it is connected, at least two side by side ones of said plurality of weft members being differently colored from at least one of the remaining ones of said weft members connected along said one of said first, second, third and fourth border portions; and providing a plurality of warp members connected in a row in spaced relationship to one another along another of said first, second, third and fourth border portions which is orthogonally disposed relative to said one of said first, second, third and fourth border portions to which said plurality of weft members are connected; connecting said plurality of warp members to one of said first, second, third and fourth border portions by splicing each of said warp members at one end thereof into the associated border portion to which it is connected, at least two side by side ones of said plurality of weft members being differently colored from at least one of the remaining ones of said warp members connected in said row in spaced relationship to one another along another of said first, second, third and fourth border portions such that said weft and said warp members together create horizontally extending rungs and vertically extending rails by the interconnection of weft and weft members, warp and warp members and weft and warp members such that each weft and each warp member makes up at least one rung and one rail of the net and at least one of said weft and warp members being of a different color displaying a diagonally directed path along the net relative to the differently colored ones of the warp and weft members.

9. A method as defined in claim 8 further characterized by connecting said weft members at one end thereof along said first border portion and connecting said warp members at one end thereof along said fourth border portion and, taking the most proximate weft and warp members relative to said first corner, the first of such weft members pierces the first of the warp members and the first of said weft members is turned laterally ninety degrees after piercing the first warp member towards said second border portion and said second weft member pierces the laterally extending portion of the first weft member so that a border portion of said first warp member is downwardly turned and pierces a second warp member and is thereafter turned laterally 90 degrees toward said second border portion in progression until a plurality of rails and rungs are created between the border portions of the net.

10. A method as defined in claim 8 further characterized by providing each of said weft and warp members as a twisted member made from a microfine multifilament consisting essentially of polypropylene or propylene ethylene copolymer having at least three strands comprised of reverse twisted microfine elongate multifilaments which in turn are twisted to create each of the weft and warp members.

11. A method as defined in claim 10 further characterized by forming said weft and warp members from a color-fast material each having a different color to create a diagonally extending color pattern in said net.

* * * * *